US005281088A

United States Patent [19]

Brandt

[11] Patent Number: 5,281,088

[45] Date of Patent: Jan. 25, 1994

[54] CENTRIFUGAL PUMP IMPELLER, AND IN COMBINATION WITH A CENTRIFUGAL PUMP HOUSING

[75] Inventor: Bengt A. Brandt, Sundbyberg, Sweden

[73] Assignee: ITT Flygt AB, Solna, Sweden

[21] Appl. No.: 927,907

[22] Filed: Aug. 10, 1992

[30] Foreign Application Priority Data

Sep. 3, 1991 [SE] Sweden ..... 9102518

[51] Int. Cl.[5] ..... F04D 29/08

[52] U.S. Cl. ..... 415/171.1

[58] Field of Search ..... 415/170.1, 171.1

[56] References Cited

U.S. PATENT DOCUMENTS

| | | | |
|---|---|---|---|
| 1,967,316 | 7/1934 | Meeker | 415/171.1 |
| 2,349,731 | 5/1944 | Hornschuch | 415/171.1 |
| 2,649,050 | 8/1953 | Dibdin | 415/171.1 |
| 3,371,613 | 3/1968 | Dahlgren et al. | 103/87 |
| 4,527,947 | 7/1985 | Elliott | 415/171.1 |
| 4,854,820 | 8/1989 | Zolotar et al. | 415/171.1 |
| 5,076,757 | 12/1991 | Dorsch | 415/171.1 |

FOREIGN PATENT DOCUMENTS

| | | | |
|---|---|---|---|
| 252816 | 7/1964 | Australia | 415/171.1 |
| 712462 | 10/1941 | Fed. Rep. of Germany | 415/171.1 |
| 62203 | 6/1978 | Japan | 415/171.1 |

*Primary Examiner*—John T. Kwon
*Attorney, Agent, or Firm*—Menotti J. Lombardi

[57] ABSTRACT

Atop the impeller are ancillary vanes, the same provided for pumping cooling liquid to the centrifugal pump motor cooling system. The liquid is conveyed through a narrow slot, vertically, which obtains between an annulus of the pump housing and an impeller extension. Grooves, contiguous with inner tips of the ancillary vanes, and formed in the extension, widen the slot, cyclically, coincident with rotation of the impeller, and hasten deaeration of air bubbles which exist, at start-up, between the impeller and the pump housing.

2 Claims, 3 Drawing Sheets

CENTRIFUGAL PUMP IMPELLER, AND IN COMBINATION WITH A CENTRIFUGAL PUMP HOUSING

BACKGROUND OF THE INVENTION

This invention pertains to centrifugal pump impellers, and to such impellers in combination with centrifugal pump housings, used to pump liquids which contain solid pollutants, and in particular to such impellers which cooperate with the pump housings to supply the pumped liquid to a cooling system which keeps the pump motor from overheating.

A common centrifugal pump is the so-called submersible pump in which the pump and its electric motor comprise a unit which is submersed in the pumped liquid. In this, the motor is normally cooled directly by the surrounding, pumped liquid. If, however, the level of the liquid decreases, so that the motor is surrounded by air, the cooling may be insufficient. Therefore, the motor is provided with an internal cooling system which uses the pumped liquid. An example of such an arrangement is shown in the Swedish Patent No. 367 465 (U.S. Pat. No. 3,371,613).

As the pumped liquid often contains solid pollutants, the aforesaid patent teaches the use of a narrow slot, arranged between the impeller and the pump housing, through which comparatively clean liquid is fed into the cooling liquid area between the pump and the motor. The cooling liquid is circulated by means of vanes arranged on the back of the impeller. The slot prevents pollutants from entering into the cooling liquid area and, thus, diminishes the possibility of clogging the cooling channels disposed about the motor.

Further, according to the aforesaid patent, vanes are arranged within the cooling jacket of the motor to convey the cooling liquid upwardly to effect a cooling of the entire motor.

It has been observed that, at pump start-up, air bubbles can collect within the cooling liquid area at the back of the impeller, i.e., between the pump housing and the impeller. As a consequence, the vanes in the cooling jacket may not be able to ingest the cooling liquid and no circulation of the latter can result.

SUMMARY OF THE INVENTION

It is an object of this invention to set forth a centrifugal pump impeller, and the same in combination with a centrifugal pump housing, which solves the aforesaid air bubbles collection.

Particularly, it is an object of this invention to set forth a centrifugal pump impeller, for pumping liquids containing solid pollutants, having a vertical axis, comprising means defining a central, axially-directed inlet for said impeller; a plurality of outwardly-directed vanes arranged about said inlet; and ancillary vanes formed atop said impeller; wherein said ancillary vanes have terminal tips; and said impeller further has means formed therein which is cooperative with said vane tips to direct liquid (a) therebetween, and (b) axially therefrom.

DETAILED DESCRIPTION OF THE PREFERRED EMBODIMENT

Figure 1:
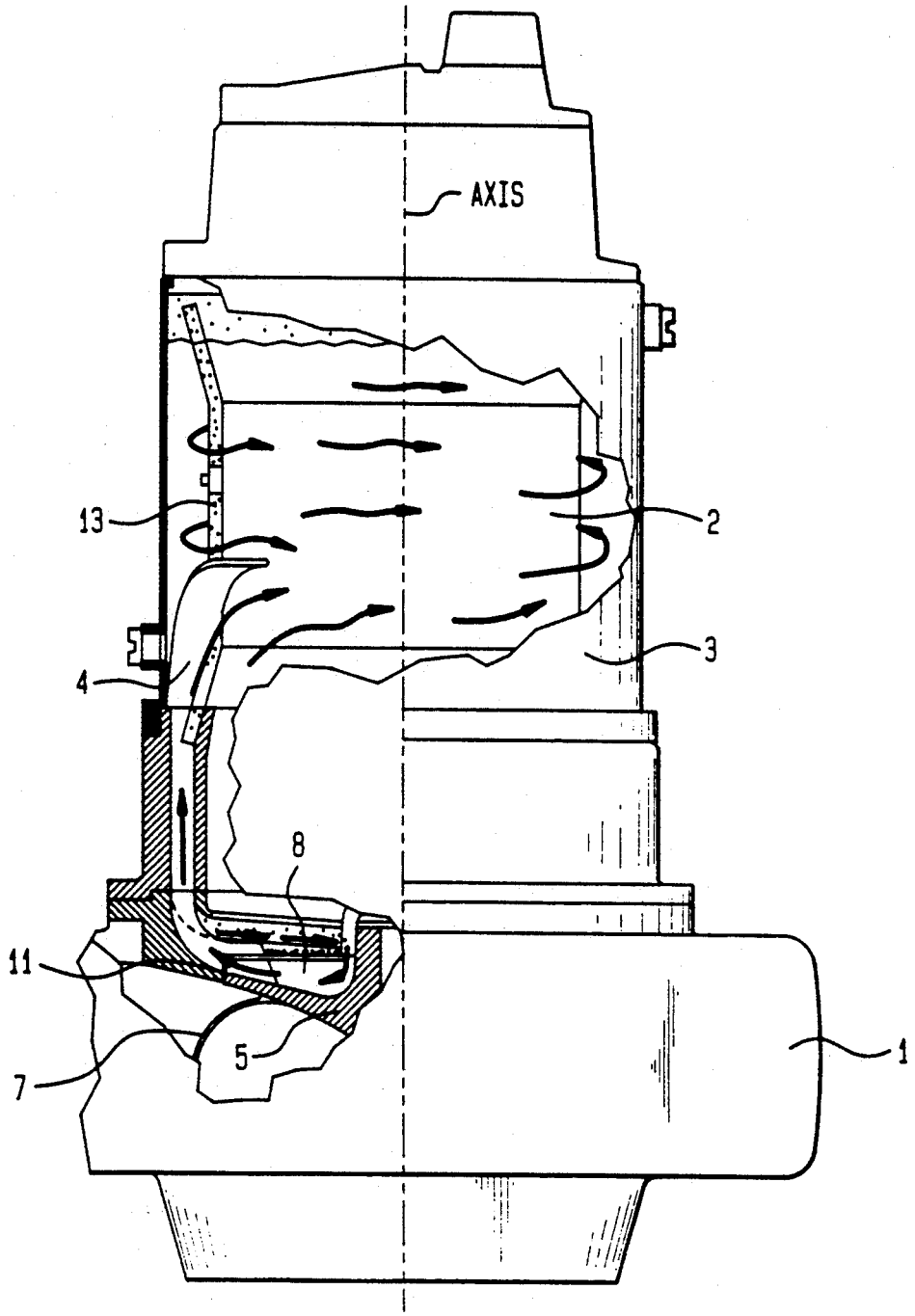
FIG. 1 is a vertical illustration, partly cut away, of a centrifugal pump and motor, and the cooling system for the latter, incorporating an embodiment of the invention.

As shown in the drawings, a centrifugal pump housing 1 mounts an electric motor 2 thereupon. The latter is surrounded by a cooling jacket 3 in which are disposed vanes 4 for directing cooling liquid for circulation thereof within the jacket 3. The novel impeller 5 has a liquid inlet 6, and primary vanes 7 arranged thereabout. Too, atop the impeller 5 are ancillary vanes 8. Rising from atop the impeller 5 is a short extension 9, of annular configuration, which confronts a depending annulus 10 of the pump housing 1. The extension 9 and annulus 10 define a narrow slot 11 therebetween. Grooves 12, formed in said extension 9, directed radially inwardly, are contiguous with tip terminations 14 of the ancillary vanes 8. An exhaust pipe 13 is coupled to the motor 2 to direct air bubbles therethrough.

Liquid is conducted through the slot 11, between the impeller 5 and the pump housing 1, and circulated around the motor 2 via a slot (not shown) at the bottom of the jacket 3.

Figure 2:
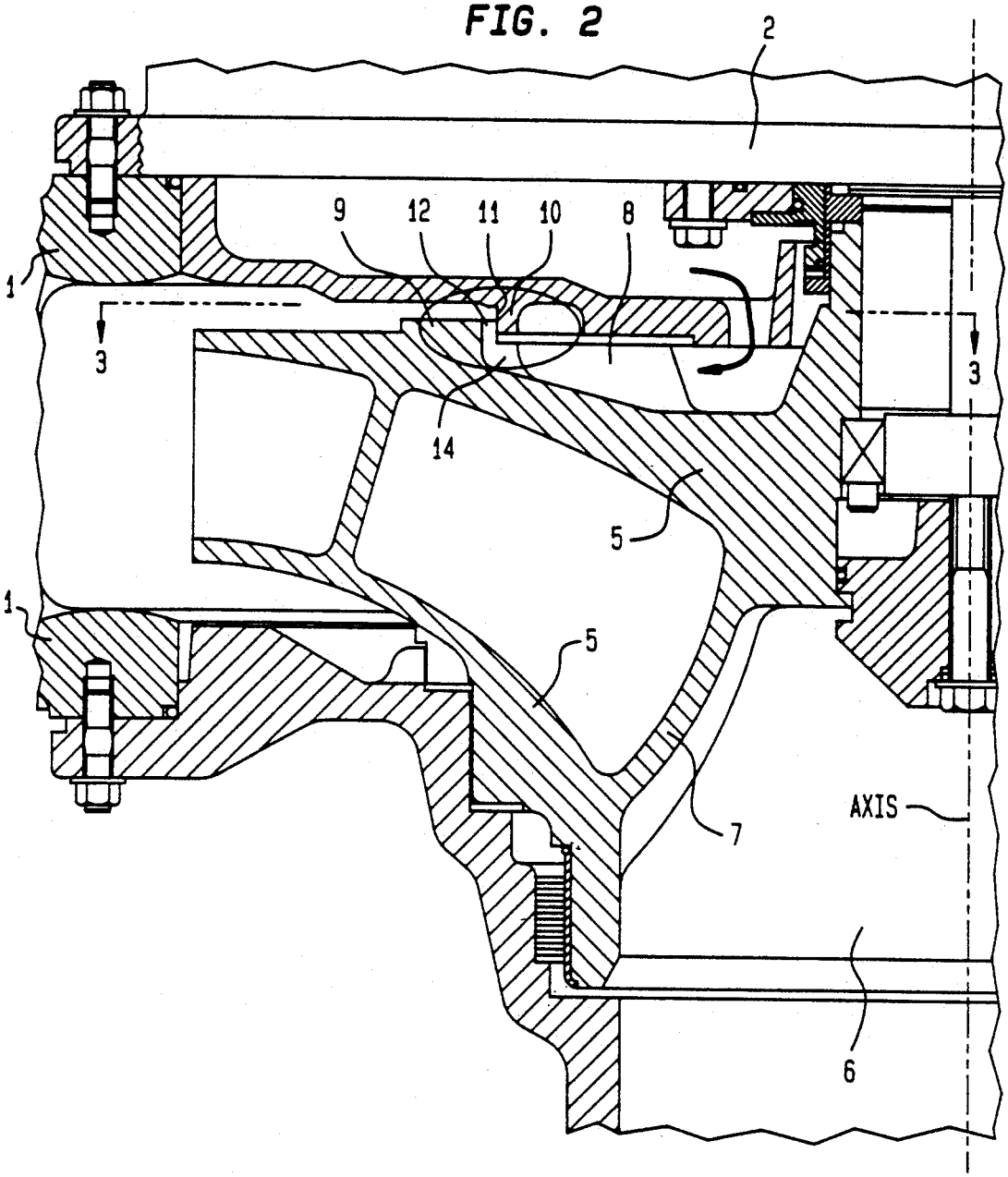
FIG. 2 is a cross-section taken from section 2—2 of FIG. 3 which depicts the aforesaid embodiment.
Figure 2A:
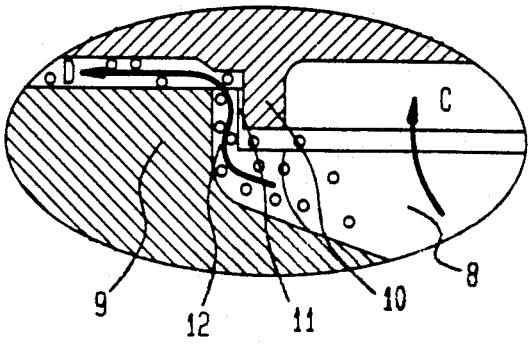
FIG. 2A is an enlarged detail of the elliptically circumscribed area of FIG. 2.
Figure 3:
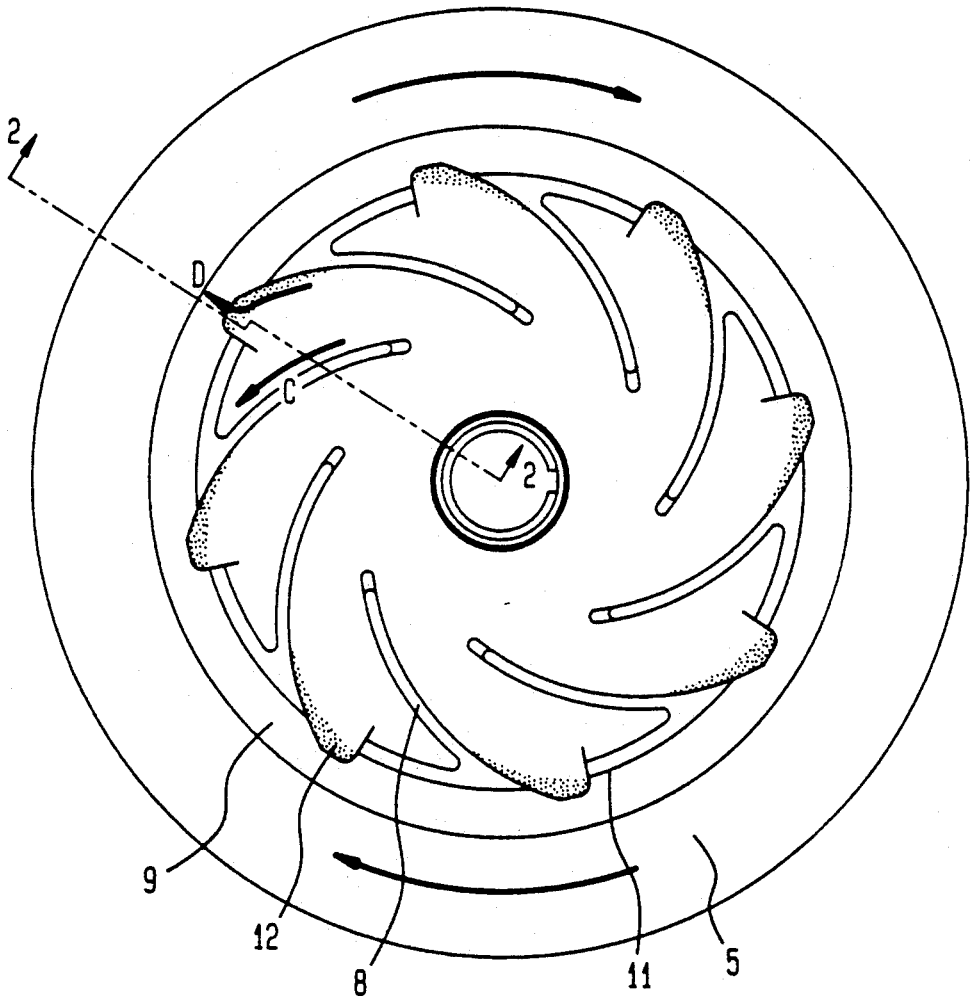
FIG. 3 is a plan or top view of the impeller, according to the disclosed embodiment thereof, taken along plane 3—3 of FIG. 2.

The ancillary vanes 8 impel cooling liquid through the slot 11, as aforesaid, and establish the circulation "C" (FIG. 2).

The air present in the cooling liquid area, between the impeller and the pump housing, at start-up, makes the pumping of the cooling liquid difficult. It collects at the back sides of the vanes 8 and particularly at their tips 14. In order to overcome the blocking effect of air bubbles thereat, the extension 9 has the aforementioned grooves 12. Effectively, the grooves present widenings of the slot 11, coincident with rotation of the impeller 5, and direct the air bubbles outwardly toward the jacket 3, as shown by flow direction "D". The grooves facilitate the pumping of the cooling liquid. Test have proven that, at start-up, deaeration or air bubble evacuation time has been reduced to one third of the time priorly necessary, with the practice of this invention. Too, as the grooves 12 are contiguous with the tips of the vanes 8, there is no likelihood that pollutants in the pumped liquid will enter the grooves-widened slot 11.

While I have described my invention in connection with a specific embodiment thereof, it is to be clearly understood that this is done only by way of example, and not as a limitation to the scope of the invention, as set forth in the objects thereof and in the appended claims.

I claim:

1. A centrifugal pump impeller, in combination with a motor, a cooling jacket, and a centrifugal pump housing which has a depending annulus, comprising:

an annular extension projecting axially from atop said impeller, and confronting said depending annulus of said housing to form a slot therebetween;

means formed in said extension which is cooperative with said annulus for directing liquid axially in said slot between said annulus and said extension;

said cooperative means comprises axially-directed grooves formed in said extension;

said impeller has vanes formed thereupon which are vertically upstanding; and said vanes have terminal tips which are contiguous with said grooves.

2. A centrifugal pump impeller, in combination with a motor, a cooling jacket surrounding said motor and a centrifugal pump housing which has a depending annulus, comprising:

an annular extension projecting vertically from atop said impeller; wherein said extension has an annular surface which (a) confronts said depending annulus of said pump housing, and (b) cooperates with said depending annulus to define a slot between said annulus and said extension for directing liquid axially in said slot;

means formed in said extension for cyclically widening said slot coincident with rotation of said impeller;

said slot widening means comprises grooves formed in said extension which extend radially inward from said extension; and said impeller has vanes formed thereon with terminal tips which are contiguous with said grooves.

* * * * *